US008449106B2

(12) United States Patent
Toya

(10) Patent No.: US 8,449,106 B2
(45) Date of Patent: May 28, 2013

(54) IMAGE RECORDING DEVICE AND IMAGE RECORDING METHOD

(75) Inventor: Akihiro Toya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 109 days.

(21) Appl. No.: 13/208,490

(22) Filed: Aug. 12, 2011

(65) Prior Publication Data

US 2012/0062638 A1 Mar. 15, 2012

(30) Foreign Application Priority Data

Sep. 10, 2010 (JP) ..... 2010-203214

(51) Int. Cl.
*B41J 2/01* (2006.01)

(52) U.S. Cl.
USPC ..... 347/104; 347/16; 347/101

(58) Field of Classification Search
USPC ..... 347/9, 14, 16, 20, 101, 102, 104, 347/105
See application file for complete search history.

(56) References Cited

U.S. PATENT DOCUMENTS 5,124,728 A * 6/1992 Denda ..... 347/104
7,390,085 B2 * 6/2008 Ishii et al. ..... 347/104

FOREIGN PATENT DOCUMENTS

JP 2005-246908 A 9/2005

* cited by examiner

*Primary Examiner* — Juanita D Jackson
(74) *Attorney, Agent, or Firm* — Global IP Counselors, LLP

(57) ABSTRACT

An image recording device includes a conveying part that conveys a portion of a medium to an image recording area, a recording part that records an image on the medium positioned in the image recording area, a medium support part that supports the medium positioned in the image recording area on a support surface provided with openings of suction holes and that heats the medium, a suction part that suctions the medium supported on the medium support part via the suction holes, and a control part that repeatedly performs a conveying action and a recording action, and that suctions the medium supported on the medium support part after the next conveying action and before the recording action when a period from the previous conveying action until the next conveying action is equal to or greater than a predetermined period that is longer than the period required by the recording action.

5 Claims, 7 Drawing Sheets

| Type Of Medium (Type Of Roll Paper) | Period For Wrinkle-Eliminating Action |
|---|---|
| Film | 5 Sec. |
| Coated Paper | 10 Sec. |
| High-Quality Paper | 15 Sec. |

Fig. 7

| Timer Count Value T (Sec.) | Period For Wrinkle-Eliminating Action |
|---|---|
| $T < 60$ | 0 Sec. |
| $60 \leq T < 70$ | 10 Sec. |
| $70 \leq T < 80$ | 15 Sec. |
| $80 \leq T$ | 20 Sec. |

Fig. 8

IMAGE RECORDING DEVICE AND IMAGE RECORDING METHOD

CROSS-REFERENCE TO RELATED APPLICATIONS

This application claims priority to Japanese Patent Application No. 2010-203214 filed on Sep. 10, 2010. The entire disclosure of Japanese Patent Application No. 2010-203214 is hereby incorporated herein by reference.

BACKGROUND

1. Technical Field

The present invention relates to an image recording device and an image recording method.

2. Related Art

There is a known image recording device in which ink discharged from a head onto a medium on a platen is dried by heating of the medium (e.g. Japanese Laid-Open Patent Publication No. 2005-246908).

SUMMARY

When the same region of the medium is heated for a long period of time, different amounts of moisture evaporate in the heated region of the medium and the region of the medium not being heated, and wrinkles form in the medium.

The present invention was devised in view of such circumstances, and an object thereof is to eliminate wrinkles formed in a medium.

An image recording device according to one aspect of the present invention includes a conveying part, a recording part, a medium support part, a suction part, and a control part. The conveying part is configured and arranged to convey a portion of a medium to an image recording area. The recording part is configured and arranged to record an image on the medium positioned in the image recording area. The medium support part is configured and arranged to heat the medium positioned in the image recording area and to support the medium on a support surface provided with openings of suction holes. The suction part is configured and arranged to suction the medium supported on the medium support part via the suction holes. The control part is configured to repeatedly perform an action of conveying the medium using the conveying part and a recording action using the recording part. The control part is configured to perform a first conveying action, a first recording action, a second conveying action, and a second recording action in the stated order. The control part is further configured to perform a suction action after the second conveying action and before the second recording action, wherein the medium supported on the medium support part is suctioned by the suction part, when a period from end of the first conveying action until start of the second conveying action is equal to or greater than a predetermined period that is longer than a period required by the first recording action.

Other characteristics of the present invention will be made clear by the descriptions of the Specification and the accompanying drawings.

BRIEF DESCRIPTION OF THE DRAWINGS

Referring now to the attached drawings which form a part of this original disclosure:

FIG. 7 is a chart showing a table which correlates the period for the wrinkle-eliminating action with the type of medium; and FIG. 8 is a chart showing a table which correlates the period for the wrinkle-eliminating action with the period for the conveying action.

DETAILED DESCRIPTION OF EXEMPLARY EMBODIMENTS

Figure 1:
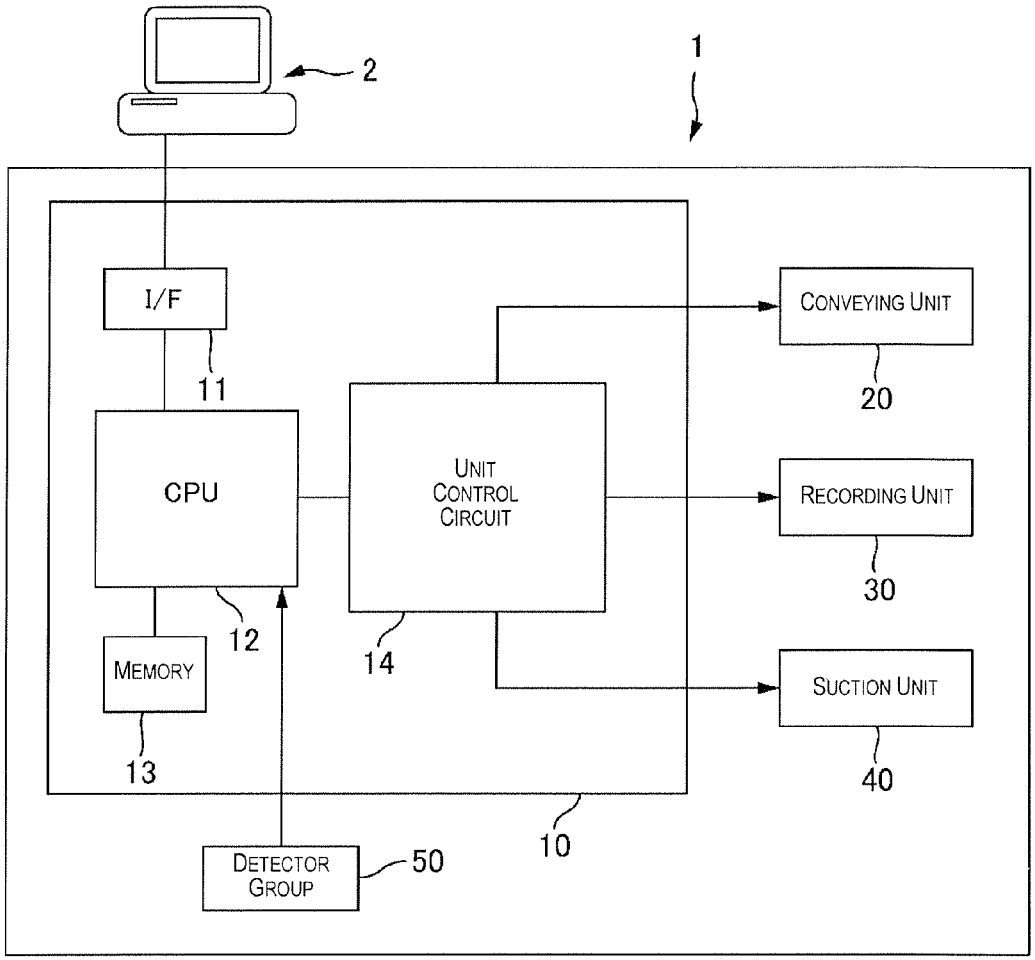
FIG. 1 is an overall configuration block diagram of a printer.

At least the following matters will be made clear from the descriptions of the Specification and the accompanying drawings.

Specifically, an image recording device according to the embodiment includes a conveying part, a recording part, a medium support part, a suction part, and a control part. The conveying part is configured and arranged to convey a portion of a medium to an image recording area. The recording part is configured and arranged to record an image on the medium positioned in the image recording area. The medium support part is configured and arranged to heat the medium positioned in the image recording area and to support the medium on a support surface provided with openings of suction holes. The suction part is configured and arranged to suction the medium supported on the medium support part via the suction holes. The control part is configured to repeatedly perform an action of conveying the medium using the conveying part and a recording action using the recording part. The control part is configured to perform a first conveying action, a first recording action, a second conveying action, and a second recording action in the stated order. The control part is further configured to perform a suction action after the second conveying action and before the second recording action, wherein the medium supported on the medium support part is suctioned by the suction part, when a period from end of the first conveying action until start of the second conveying action is equal to or greater than a predetermined period that is longer than a period required by the first recording action.

With such an image recording device, wrinkles that form in the medium can be eliminated. Since images are recorded with wrinkles having been eliminated from the medium, loss of image quality can be minimized.

In this image recording device, the control part is preferably configured to vary a period over which the suction action is performed in accordance with a type of the medium.

With such an image recording device, wrinkles that form in the medium can be eliminated, and image productivity can be increased.

In this image recording device, the control part is preferably configured to vary a period over which the suction action is performed in accordance with a period from a previous conveying action to a next conveying action.

With such an image recording device, wrinkles that form in the medium can be eliminated, and image productivity can be increased.

In this image recording device, the suction part is preferably configured to apply a suction force during the suction action to suction the medium supported on the medium support part, which is greater than a suction force applied during the conveying action to suction the medium supported on the medium support part.

With such an image recording device, wrinkles that form in the medium can be eliminated, and the medium can be conveyed smoothly.

An image recording method according to the embodiment is a method for recording an image on a medium by an image recording device including: a conveying part configured and arranged to convey a portion of a medium to an image recording area; a recording part configured and arranged to record an image on the medium positioned in the image recording area; a medium support part configured and arranged to heat the medium positioned in the image recording area and to support the medium on a support surface provided with openings of suction holes; a suction part configured and arranged to suction the medium supported on the medium support part via the suction holes; and a control part configured to repeatedly perform an action of conveying the medium using the conveying part and a recording action using the recording part. The image recording method includes, when a period from a previous conveying action until a next conveying action is equal to or greater than a predetermined period that is longer than a period required by the recording action, performing a suction action by using the control part after the next conveying action and before the recording action, wherein the medium supported on the medium support part is suctioned by the suction part.

With such an image recording method, images can be recorded in a state in which wrinkles that form in the medium have been eliminated.

Printer

An embodiment is described hereinbelow using an inkjet printer (hereinbelow, a printer) as an example of the "image recording device."

Figure 2:
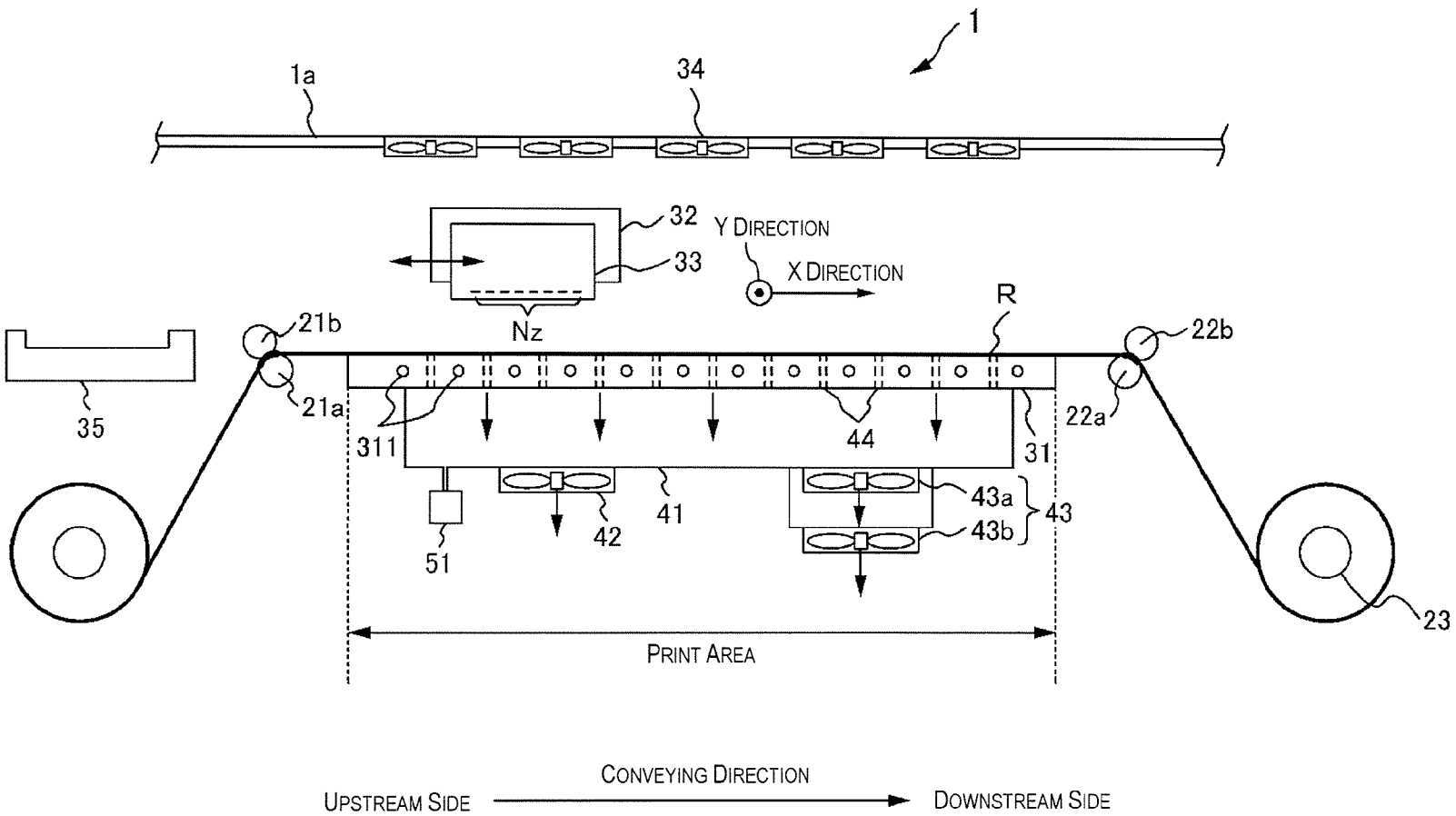
FIG. 2 is a cross-sectional view showing an outline of the printer.

FIG. 1 is an overall configuration block diagram of a printer 1. FIG. 2 is a cross-sectional view showing an outline of the printer 1. The printer 1 of the present embodiment prints images on roll paper R (continuous paper) as a medium. The medium is not limited to paper, and may be film or cloth, for example. The printer 1 of the present embodiment is communicably connected with a computer 2, and the computer 2 creates print data for causing the printer 1 to print images. The functions of the computer 2 may also be installed within the printer 1.

A controller 10 is a control unit for controlling the printer 1. An interface 11 is for conducting the transmission of data between the computer 2 and the printer 1. A CPU 12 is a computing and processing device for controlling the entire printer 1. A memory 13 is for ensuring areas for storing the programs of the CPU 12, operational areas, and the like. The CPU 12 controls the units in accordance with a unit control circuit 14. A detector group 50 observes conditions within the printer 1 and a controller 10 controls the units on the basis of the detection results.

A conveying unit 20 (equivalent to the conveying part) is for conveying the roll paper R from an upstream side to a downstream side of a conveying direction along a preset conveying route, and is also for conveying part of the roll paper R to a print area (equivalent to the image recording area). The conveying unit 20 has supply rollers 21*a*, 21*b*, ejection rollers 22*a*, 22*b*, a winding roller 23, and other components. The supply rollers 21*a*, 21*b* and the ejection rollers 22*a*, 22*b* are each composed of rollers constituting pairs, wherein one roller is a drive roller rotated by a motor (not shown), while the other roller is a driven roller rotated in conjunction with the drive roller. When image printing on the roll paper R positioned in the print area ends, the region of the roll paper R on which the image is printed is ejected from the print area by the supply rollers 21*a*, 21*b*, the ejection rollers 22*a*, 22*b*, and other components, then wound up into a roll by the winding roller 23, and a region of the roll paper R on which no image has yet been printed is supplied to the print area.

A recording unit 30 (equivalent to the recording part) is for printing (recording) images on the roll paper R positioned in the print area. The roll paper R positioned in the print area is supported from the back surface opposite the printed surface by the top surface of a platen 31 (equivalent to the medium support part). The recording unit 30 has a carriage 32, a head 33, and other components. The carriage 32 moves the head 33 in an X direction (the conveying direction of the roll paper R) and a Y direction (the width direction of the roll paper R) while being guided on a guide shaft (not shown). The head 33 is for discharging ink onto the roll paper R, and the underside of the head 33 is provided with a plurality of nozzles Nz which are ink discharge parts. The system whereby ink is discharged from the nozzles may be a piezo system which applies voltage to drive elements (piezo elements) and expands and contracts pressure chambers to discharge ink, or a thermal system which uses heat-generating elements to form bubbles in the nozzles and discharges ink by the bubbles.

A plurality of heaters 311 (e.g. nichrome wires) are set up inside the platen 31. Supplying electricity to the heaters 311 causes the temperature of the platen 31 to rise, and the temperature of the roll paper R on the platen 31 (i.e. the roll paper R positioned in the print area) also rises. As a result, drying of the ink deposited on the roll paper R on the platen 31 can be promoted, and blurring of the ink in the print area can be suppressed. The heaters 311 are set up through the entire platen 31 so that heat is evenly conducted to the roll paper R on the platen 31. Thus, the platen 31 supports the roll paper R positioned in the print area on the top surface (the support surface), and heats the roll paper R positioned in the print area as well.

In the ceiling 1*a* of the casing of the printer 1, a plurality of ceiling fans 34 are provided so as to face the platen 31. Air is blown from the ceiling fans 34 onto the roll paper R on the platen 31, whereby drying of the ink deposited on the roll paper R on the platen 31 can be promoted.

The carriage 32 and the head 33 are capable of withdrawing to a home position which is upstream of the print area in the conveying direction. A cap mechanism 35 or the like is provided to the home position. While printing has stopped, evaporation of ink from the nozzles can be suppressed by tightly sealing the nozzle surface of the head 33 by the cap mechanism 35.

A suction unit 40 (equivalent to the suction part) is for holding the roll paper R on the platen 31 to the support surface of the platen 31 by suction, and the suction unit 40 has a negative pressure chamber 41, a first fan mechanism 42, a second fan mechanism 43, suction holes 44, and other components. The negative pressure chamber 41 is connected to the bottom surface of the platen 31, and the first fan mechanism 42 and second fan mechanism 43 are attached to the bottom surface of the negative pressure chamber 41 and aligned in the conveying direction. The second fan mechanism 43 is composed of two fans 43*a*, 43*b*, wherein to the underside of one fan 43*a* (the discharge opening side) is attached the other fan 43*b*. The suction holes 44, which are holes extending in the vertical direction, are formed through the platen 31, and the openings on one side of the suction holes 44 are formed in the support surface of the platen 31, while the openings on the other side of the suction holes 44 are formed in the bottom surface of the platen 31 (the surface where the platen 31 and the negative pressure chamber 41 connect). Specifically, the negative pressure chamber 41 is communicated with the exterior (the top part of the platen 31) via the suction holes 44.

The first fan mechanism 42 and the second fan mechanism 43 blow air in the negative pressure chamber 41 out to the exterior (specifically, suction out the air in the negative pressure chamber 41), creating a state of negative pressure inside the negative pressure chamber 41. At this time, the outside air above the support surface of the platen 31 is suctioned into the negative pressure chamber 41 via the suction holes 44, and the roll paper R on the platen 31 is held on the support surface of the platen 31 by suction. Specifically, the suction unit 40 suctions the roll paper R supported on the platen 31 via the suction holes 44.

During printing, due to the roll paper R on the platen 31 being held by suction on the support surface of the platen 31, the roll paper R is held in a predetermined position in the support surface of the platen 31, and ink droplets can be deposited in the proper positions. The roll paper R can also be kept flat even if the roll paper R swells due to the moisture in the ink droplets.

With such a printer 1, the controller 10 (equivalent to the control part) causes the head 33 to print (equivalent to the recording action) a two-dimensional image on the roll paper R positioned in the print area while moving the head 33 and the carriage 32 in the X direction and Y direction. The controller 10 then causes the conveying unit 20 to eject the region of the roll paper R that has the printed image out of the print area, and to supply the region of the roll paper R not yet having an image printed to the print area (equivalent to the conveying action). In other words, by repeatedly performing the image printing action and the roll paper R conveying action, the controller 10 causes numerous images to be printed along the direction in which the roll paper R continues.

Maintenance Action

The moisture in the ink readily evaporates from the menisci of the nozzles (the free surfaces of the ink exposed to the exterior), and the viscosity of the ink increases due to this evaporation. When the ink increases in viscosity, the prescribed amount of ink is not discharged when the ink should be discharged from the nozzles, and discharging becomes less efficient. Atmospheric air gets mixed in through the menisci of the nozzles, and foreign substances adhere to the nozzles, causing discharge to be less efficient. When nozzle discharge becomes less efficient, the printed image quality suffers.

In view of this, with the printer 1 of the present embodiment, a maintenance action is performed periodically. The term "maintenance action" refers to a "discharge problem inspection" for detecting whether or not there are nozzles having discharge problems (problematic nozzles), or a "cleaning action" for ensuring that ink is not discharged as normal from the problematic nozzles. In the maintenance action, for example, one option is that the cleaning action be performed only when problematic nozzles have been detected after the discharge problem inspection has been performed, and another option is that the cleaning action and the discharge problem inspection be repeatedly performed until problematic nozzles are no longer detected.

Discharge Problem Inspection

A discharge problem inspection unit (not shown) of the present embodiment has detection electrodes of high electric potential, an ink recovery part, and other components, and the detection electrodes are placed inside the ink recovery part. The nozzle surface of the head 33 (the nozzle plate; a plate-shaped member having electrical conductivity) is connected to ground, having a lower electric potential (ground potential) than the detection electrodes, and the solvent of the ink is a liquid (e.g. water) having electrical conductivity. Consequently, the ink discharged from the nozzles has ground potential.

During the discharge problem inspection, first, the head 33 is withdrawn to the home position. The head 33 (the nozzle plate) and the detection electrodes then face each other across a predetermined distance, and ink is discharged (continuously) from the nozzles being inspected. Based on electrical variation (electric potential variation) detection electrodes as caused by ink discharge, a determination is made of whether or not ink droplets have been discharged properly from the nozzles being detected. For example, electrical variation occurring in the detection electrodes is acquired as a voltage signal, and if the maximum amplitude of the voltage signal is greater than a threshold, it is determined that ink has been discharged properly from the nozzles, whereas if the maximum amplitude of the voltage signal is equal to or less than a threshold, it is determined that ink has not been discharged properly from the nozzles. Since the ink discharged from the nozzles to the detection electrodes is recovered by the ink recovery part, the interior of the printer 1 can be prevented from getting dirty. The discharge problem inspection method is not limited to this example, and other methods may be used.

Cleaning Action

In the present embodiment, flushing, pump suction, wiping, or the like is performed as the cleaning action. As during the discharge problem inspection, the head 33 is withdrawn to the home position during the cleaning action as well.

The term "flushing" refers to the action of forcefully discharging ink from the nozzles while the head 33 and the ink recovery part (not shown) are facing each other, and causing the more viscous ink and foreign substances adhering to the nozzle surface to be discharged along with the ink.

The term "pump suction" refers to an action of firmly pressing the nozzle surface of the head 33 and the ink recovery part together and applying pump suction via a tube connected to the bottom surface of the ink recovery part (not shown), thereby suctioning out the ink in the head 33 along with the more viscous ink and foreign substances.

The term "wiping" refers to an action of scraping the nozzle surface with a rubber wiper or the like to remove foreign substances and the like.

High Negative Pressure Mode and Low Negative Pressure Mode

With the printer 1 of the present embodiment, in order to hold the roll paper R on the platen 31 to the support surface of the platen 31 by suction, the air in the negative pressure chamber 41 is blown out by the first fan mechanism 42 and the second fan mechanism 43, creating a state of negative pressure in the negative pressure chamber 41 and suctioning the roll paper R on the platen 31 through the suction holes 44.

During printing, the suction-holding force of the roll paper R on the support surface of the platen 31 should be as strong as possible in order to hold the roll paper R on the platen 31 in a predetermined position and to keep the roll paper R flat even if the roll paper R swells due to the moisture in the ink. While the roll paper R is being conveyed, the suction-holding force of the roll paper R on the support surface of the platen 31 should be as low as possible without releasing the roll paper R, so as not to create a large amount of resistance against conveying. To vary the suction-holding force of the roll paper R on the support surface of the platen 31 in accordance with the actions in this manner (i.e. to vary the suction force from the suction holes 44), it is preferable to change the negative pressure inside the negative pressure chamber 41.

In view of this, in the printer 1 of the present embodiment, the "high negative pressure mode" in which the negative pressure inside the negative pressure chamber 41 is increased and the "low negative pressure mode" in which the negative pressure inside the negative pressure chamber 41 is reduced can be varied as appropriate. The pressure (negative pressure) inside the negative pressure chamber 41 is preferably set according to the force with which the conveying unit 20 conveys the roll paper R, the type of roll paper R, and other factors; for example, the pressure of the negative pressure chamber 41 in the high negative pressure mode is preferably set at 805 Pa less than atmospheric pressure, and the pressure of the negative pressure chamber 41 in the low negative pressure mode is preferably set at 140 Pa less than atmospheric pressure. A pressure sensor 51 for detecting the pressure (of air) inside the negative pressure chamber 41 is provided to the negative pressure chamber 41, and the controller 10 may confirm whether or not the pressure inside the negative pressure chamber 41 is the desired pressure (negative pressure), for example.

The controller 10 sets the pressure in the negative pressure chamber 41 to the high negative pressure mode during printing, and sets the pressure to the low negative pressure mode while the roll paper R is being conveyed. Doing this makes it possible for the suction-holding force of the roll paper R on the support surface of the platen 31 to be strengthened during printing (i.e. for the suction force from the suction holes 44 to be strengthened), and also makes it possible to keep the roll paper on the platen 31 flat in a predetermined position. While the roll paper R is being conveyed, the suction-holding force of the roll paper R on the support surface of the platen 31 can be lessened, and the roll paper is conveyed smoothly. In other words, the conveying load of the conveying unit 20 (e.g. the tension of the ejection rollers) can be reduced by setting to low negative pressure mode while the roll paper R is being conveyed.

In the printer 1 of the present embodiment, it is possible to vary between the high negative pressure mode and the low negative pressure mode by turning both the first fan mechanism 42 and the second fan mechanism 43 on during the high negative pressure mode, and turning the first fan mechanism 42 on and the second fan mechanism 43 off during the low negative pressure mode.

This is because arranging two fans 43*a*, 43*b* in series (arranging the fans so that their axes lie along the same axis) as is done with the second fan mechanism 43 can improve static pressure over the use of a single fan having the same characteristics (the first fan mechanism 42). Specifically, blowing the air in the negative pressure chamber 41 out by the second fan mechanism 43 composed of two fans arranged in series can increase the negative pressure in the negative pressure chamber 41 (reduce the pressure in the negative pressure chamber 41) more so than when the air in the negative pressure chamber 41 is blown out by the first fan mechanism 42 composed of a single fan. When the fans are arranged in parallel, as are the first fan mechanism 42 and the second fan mechanism 43, more air is blown but the static pressure mostly does not change, and it is therefore acceptable to turn on only the second fan mechanism 43 in the high negative pressure mode.

In other words, with the printer 1 of the present embodiment, providing the first fan mechanism 42 composed of one fan and the second fan mechanism 43 composed of two fans arranged in series makes it possible to increase the negative pressure in the negative pressure chamber 41 during the high negative pressure mode and to reduce the negative pressure in the negative pressure chamber 41 during the low negative pressure mode.

During the previously described maintenance action (during discharge problem inspection or the cleaning action), there is no need to strengthen the suction-holding force of the roll paper R on the support surface of the platen 31 as is done during printing. It is preferable to set to low negative pressure mode during the maintenance action. The noise and vibration during the high negative pressure mode are greater than during the low negative pressure mode because more fans are being rotated. Consequently, during the maintenance action, the noise and vibration can be reduced and power consumption can also be reduced by setting to the low negative pressure mode.

Particularly, when a discharge problem is determined based on electrical changes in the detection electrodes, as is done in the previously described discharge problem inspection, the vibration of the fan could unfortunately be a cause of noise. Consequently, the precision of discharge problem inspection can be increased by setting to the low negative pressure mode during the discharge problem inspection (during the maintenance action) and reducing the number of fans rotating to reduce vibration.

Occurrence of Wrinkles

Figures 3A, 3B:
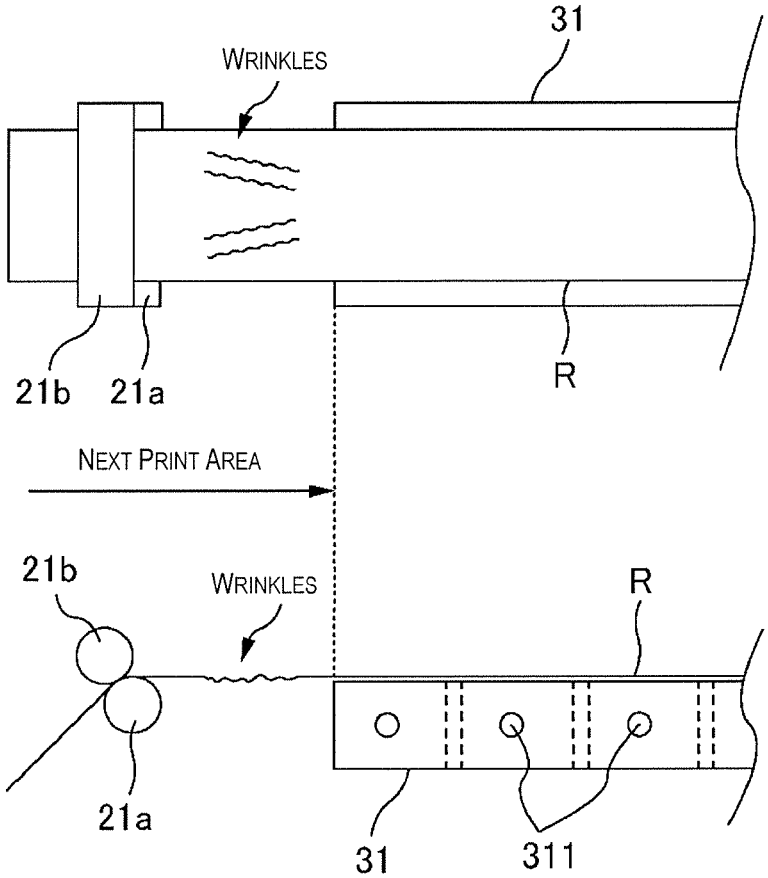
FIGS. 3A and 3B are diagrams showing how wrinkles form in roll paper.

FIGS. 3A and 3B are drawings showing how wrinkles form in roll paper R positioned between the supply rollers 21*a*, 21*b* and the platen 31. FIG. 3 is a view seen from above, and FIG. 3B is a cross-sectional view. The heaters 311 are provided to the platen 31. Therefore, the platen 31 is heated by the heat of the heaters 311, and the roll paper R is also heated, being positioned on top of the platen 31 which has been heated (hereinbelow referred to as the heated platen 31). In the present embodiment, the roll paper R positioned on the heated platen 31 is heated to about 45° C.

The heat of the heated platen 31 is transferred by only a little or even not at all to the roll paper R not positioned on the heated platen 31 (i.e. the roll paper R outside of the print area). Therefore, the temperature of the roll paper R not positioned on the heated platen 31 is about the same as the internal temperature of the printer 1. In the present embodiment, the temperature of the roll paper R not positioned on the heated platen 31 is about 18° C. to 30° C.

The heaters 311 provided to the heated platen 31 are originally for evaporating the moisture contained in the ink droplets deposited on the roll paper R, promoting drying of the ink, and suppressing blurring of the ink in the printed image. However, when the same region of the roll paper R is positioned on the heated platen 31 for a long period of time, the heat of the heaters 311 evaporates even the moisture contained within the roll paper R positioned on the heated platen 31. Since the heat of the heaters 311 is not transferred (or transferred by only a small amount) to the roll paper R not positioned on the heated platen 31, the moisture included within the roll paper R not positioned on the heated platen 31 mostly does not evaporate.

In other words, the amount of moisture evaporated differs between the region of the roll paper R that is positioned on the heated platen 31 and the region of the roll paper R that is not positioned on the heated platen 31. Consequently, when the same region of the roll paper R is positioned on the heated platen 31 for a long period of time, the difference in the amount of moisture evaporated will be great between the region of the roll paper R that is positioned on the heated platen 31 and the region of the roll paper R that is not positioned on the heated platen 31, and there will be a difference in the rate of shrinkage of the fibers constituting the roll paper R. As a result, wrinkles form in the border between the region of the roll paper R that is positioned on the heated platen 31 and the region of the roll paper R that is not positioned on the heated platen 31, as shown in FIG. 3. However, the region of the roll paper R that is positioned on the heated platen 31 is held by suction to the support surface of the heated platen 31 by the suction unit 40, maintaining flatness, and wrinkles therefore do not form readily. Consequently, wrinkles form readily in the roll paper R positioned between the heated platen 31 and the supply rollers 21*a*, 21*b*.

The roll paper R positioned between the heated platen 31 and the supply rollers 21*a*, 21*b*, i.e., the region of the roll paper R where wrinkles have formed is supplied to the print area in the next conveying action. When printing is performed with wrinkles having formed in the roll paper R, the roll paper R and the head 33 come in contact, dirtying the roll paper R, or the ink droplets discharged from the nozzles are not deposited on the proper positions. Due to wrinkles forming in the roll paper R, the heat of the heated platen 31 does not transfer readily to the roll paper R, the ink does not dry, and blurring occurs in the printed image. In other words, when printing is performed with wrinkles having formed in the roll paper R, the quality of the printed image suffers. In view of this, an object of the present embodiment is to eliminate the wrinkles that form in the roll paper R.

First Embodiment

Figure 4:
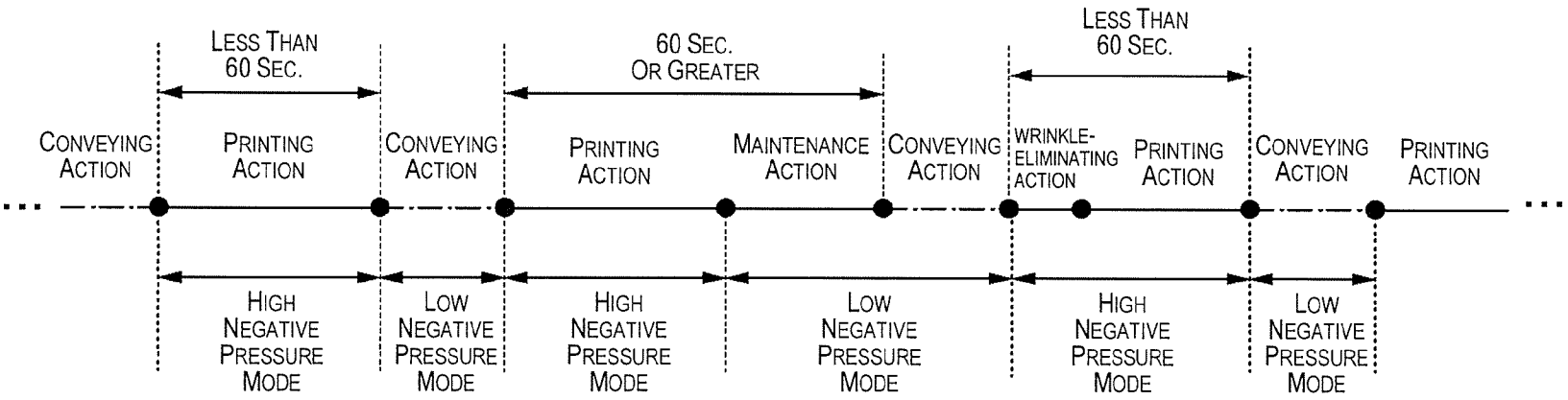
FIG. 4 is a chart describing the flow of the printing process in the first embodiment.
Figure 5:
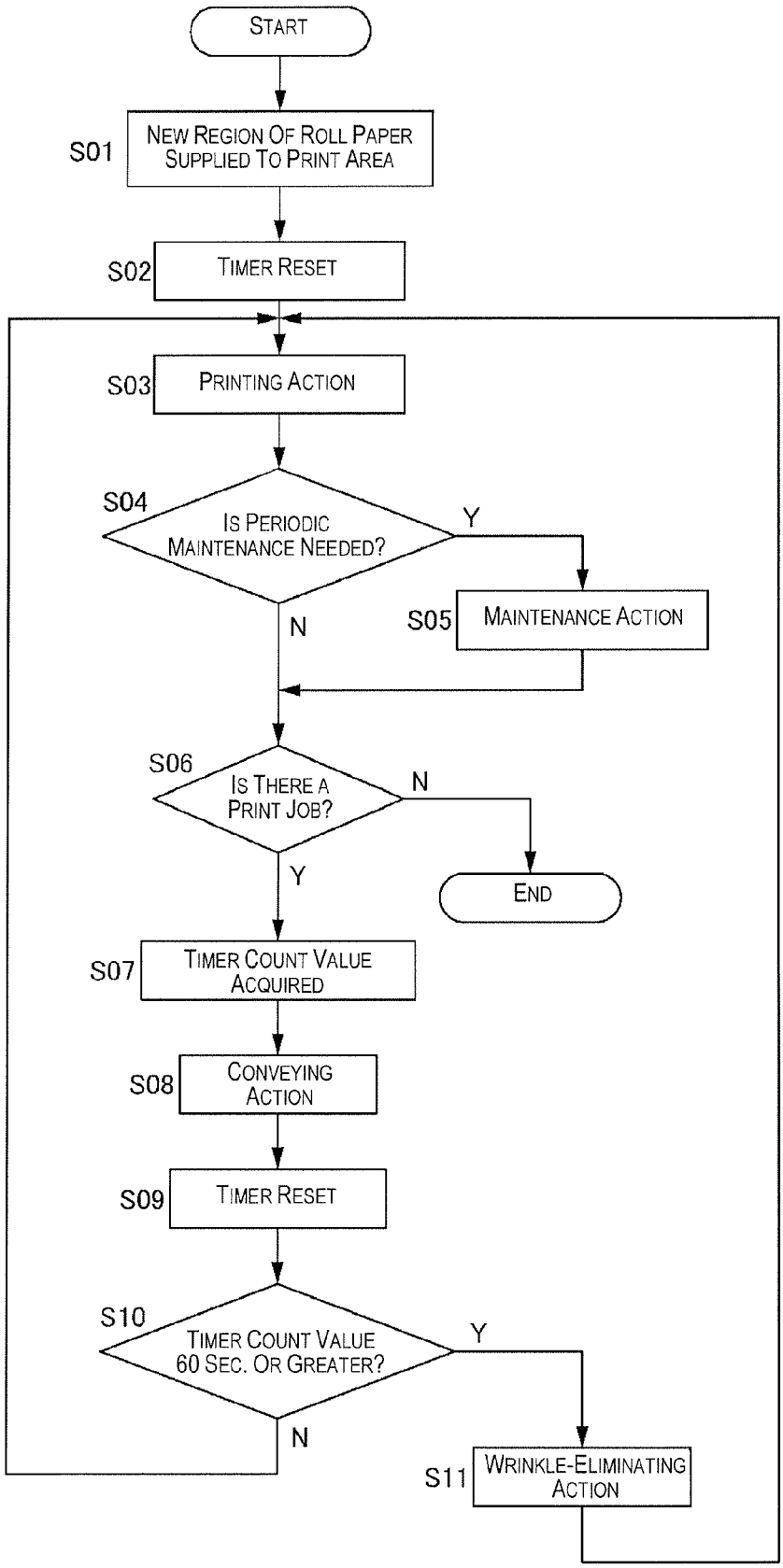
FIG. 5 is a chart describing the flow of the printing process in the first embodiment.

FIGS. 4 and 5 are charts for describing the flow of the printing process in the first embodiment. Herein is an example in which the maintenance action (the discharge problem inspection or the cleaning action) is performed periodically during the printing process, i.e., and example in which the maintenance action is performed in multiple printing actions. As shown in FIG. 4, the maintenance action is performed after the printing action, and the conveying action is performed after the maintenance action. In cases in which only the printing action is performed between conveying actions, the period (time duration) between conveying actions is comparatively short (less than 60 seconds in FIG. 4). In cases in which the printing action and the maintenance action are performed between conveying actions, the period between conveying actions is comparatively long (60 seconds or greater in FIG. 4). Though not shown in the drawings, after the maintenance action, a capping action may be performed for bringing the nozzle surface of the head 33 and the cap mechanism 35 firmly together. In this case, the period between conveying actions is even longer because the printing action, the maintenance action, and the capping action are performed between conveying actions.

A lengthening of the period between conveying actions means that the same region of the roll paper R is positioned on the heated platen 31 for a long period of time, and wrinkles form in the roll paper R positioned between the heated platen 31 and the supply rollers 21*a*, 21*b* as shown in FIG. 3. The region of roll paper R where wrinkles have formed is supplied to the print area by the next conveying action. If the printing action is performed with wrinkles having formed, the quality of the printed image will suffer due to the roll paper R and the head 33 coming in contact, for example.

In view of this, when the period from the previous conveying action to the next conveying action (in other words, the period during which the same region of the roll paper R is positioned on the heated platen 31, or the period between conveying actions) is equal to or greater than a "predetermined period (threshold)" that is longer than the period required by the printing action, the controller 10 of the printer 1 causes the suction unit 40 to perform the "wrinkle-eliminating action" after the next conveying action and before the printing action.

The wrinkle-eliminating action is an action whereby the roll paper R supported on the heated platen 31 is suctioned by the suction unit 40 (equivalent to the suction action, and in the present embodiment, the roll paper R is suctioned by the suction unit 40 at times other than the wrinkle-eliminating action as well, but the wrinkle-eliminating action is the suction action). Specifically, after the region of the roll paper R where wrinkles have formed is supplied to the print area by the conveying action, the roll paper R positioned in the print area is suctioned through the suction holes 44 without beginning the printing action. To achieve this, the first fan mechanism 42 and the second fan mechanism 43 are actuated to create negative pressure inside the negative pressure chamber 41, and the roll paper R positioned in the print area is held by suction to the support surface of the heated platen 31. This eliminates the wrinkles that had formed in the roll paper R and flattens the roll paper R positioned in the print area. In the first embodiment, the period for the wrinkle-eliminating action is constant (10 seconds, for example).

When the period between conveying actions is equal to or greater than the predetermined period (threshold), there is a chance of wrinkles forming in the roll paper R supplied to the print area in the next conveying action. In view of this, the controller 10 of the printer 1 causes the wrinkle-eliminating action to be performed and thereafter causes the printing action to be performed when the period between conveying action is equal to or greater than the predetermined period. With this type of printer 1 (or with an image recording method which records images by using this type of printer 1), since the printing action with the wrinkles that form in the roll paper R having been eliminated, it is possible to prevent contact between the roll paper R and the head 33, deviation in the positions where ink is deposited, unsatisfactory ink drying, and other problems; and the loss of quality in the printed images can be suppressed.

The wrinkle-eliminating action could be performed following all of the conveying actions, irrespective of the period between conveying actions. In this case, as in cases in which the period between conveying actions is comparatively short and no wrinkles have formed in the roll paper R, the wrinkle-eliminating action is performed needlessly, the overall printing time increases, and productivity decreases. Therefore, by performing the wrinkle-eliminating action only in cases in which the period between conveying actions is equal to or greater than the period (the predetermined period) in which there is a chance of wrinkles forming in the roll paper R, the decrease in productivity can be suppressed while eliminating the wrinkles that form in the roll paper R. Consequently, the "predetermined period" is preferably designated as the period at which wrinkles form when the same region of the roll paper R is positioned on the heated platen 31.

The threshold (predetermined period) pertaining to the period between conveying actions is longer than the period required by the printing action. Since the period required by the printing action varies according to the size of the printed image, the print resolution, and the printing method, the "predetermined period" is preferably longer than the "maximum period required by the printing action." Thereby, the wrinkle-eliminating action is performed only in cases in which the period between conveying actions has been increased by actions other than the printing action (e.g. the maintenance action), and the wrinkle-eliminating action is not performed in usual circumstances (i.e. when only the printing action is performed). Therefore, the decrease in productivity can be suppressed while eliminating the wrinkles that form in the roll paper R. The temperature of the heated platen 31 is therefore preferably set and the roll paper R and ink are preferably selected, for example, so that wrinkles do not form in the roll paper R even when the same region of the roll paper R has been positioned on the heated platen 31 during the maximum period required by the printing action.

The wrinkles that form in the roll paper R are more readily eliminated the stronger the suction force from the suction holes 44 in the wrinkle-eliminating action. In view of this, the suction force whereby the suction unit 40 suctions the roll paper R supported on the heated platen 31 during the wrinkle-eliminating action is increased to be greater than the suction force whereby the suction unit 40 suctions the roll paper R supported on the heated platen 31 during the conveying action. In the present embodiment, the suction force from the suction holes 44 in the wrinkle-eliminating action is the same as the suction force from the suction holes 44 during printing. Specifically, the pressure in the negative pressure chamber 41 is set to the "high negative pressure mode" during the wrinkle-eliminating action, as shown in FIG. 4. The pressure in the negative pressure chamber 41 during the conveying action is set to the "low negative pressure mode," and the controller 10 switches the pressure in the negative pressure chamber 41 from the "low negative pressure mode" to the "high negative pressure mode" after the conveying action. Thereby, during the conveying action, the suction force from the suction holes 44 on the roll paper R on the heated platen 31 decreases and conveying can be performed smoothly, and during the wrinkle-eliminating action, the suction force from the suction holes 44 on the roll paper R on the heated platen 31 increases and the wrinkles that form in the roll paper R can be more reliably eliminated.

In cases in which the period required by the printing action is comparatively short, the period between conveying actions will be less than the predetermined period even if the wrinkle-eliminating action and the printing action are performed between conveying actions. Moreover, in cases in which the period required by the printing action is comparatively long, when the wrinkle-eliminating action and the printing action are performed between conveying actions, the period between conveying actions will be equal to or greater than the predetermined period, and the wrinkle-eliminating action will sometimes be performed as a continuation thereafter.

The following is a detailed description, based on FIG. 5, of the flow of the printing process in which the maintenance action is periodically performed. In this case, the threshold (predetermined period) pertaining to the period between conveying actions is "60 seconds." First, when a new region of the roll paper R is supplied to the print area by the conveying action (S01), the controller 10 of the printer 1 resets the timer (S02) and performs the printing action (S03). After the printing action has ended (or during printing), the controller 10 switches the pressure in the negative pressure chamber 41 from the high negative pressure mode to the low negative pressure mode. After the printing action has ended, the controller 10 determines whether or not there is a need for periodic maintenance (i.e., determines whether or not prescribed period has elapsed since the previous maintenance action: S04). When there is no need for periodic maintenance (S04→N), the controller 10 determines whether or not there is a subsequent print job (S06). When there is a need for periodic maintenance (S04→Y), after the maintenance action has been performed (S05), the controller 10 then determines whether or not there is a subsequent print job (S06). When there is no subsequent print job (S06→N), the controller 10 ends the printing process.

When there is a subsequent print job (S06→Y), the controller 10 acquired the count value of the timer (S07). The controller 10 then supplies a new region of the roll paper R to the print area by the conveying action (S08) and resets the timer (S09). The acquiring of the timer count value and the conveying action may be performed simultaneously. The controller 10 switches the pressure in the negative pressure chamber 41 from the low negative pressure mode to the high negative pressure mode after the conveying action has ended. The controller 10 then determines whether or not the timer count value acquired in S07 is 60 seconds or greater (S10). When the acquired timer count value is 60 seconds or greater (S10→Y), after the wrinkle-eliminating action has been performed for 10 seconds (S11), the controller 10 then performs the printing action (S03). When the acquired timer count value is less than 60 seconds (S10→N), the controller 10 performs the printing action (S03) without performing the wrinkle-eliminating action.

The controller 10 repeatedly performs this series of actions until there are no longer any print jobs. The wrinkle-eliminating action is thereby performed after the next conveying action and before the printing action, only in cases in which the period between conveying actions is 60 seconds (the predetermined period) or greater.

Figure 6A:
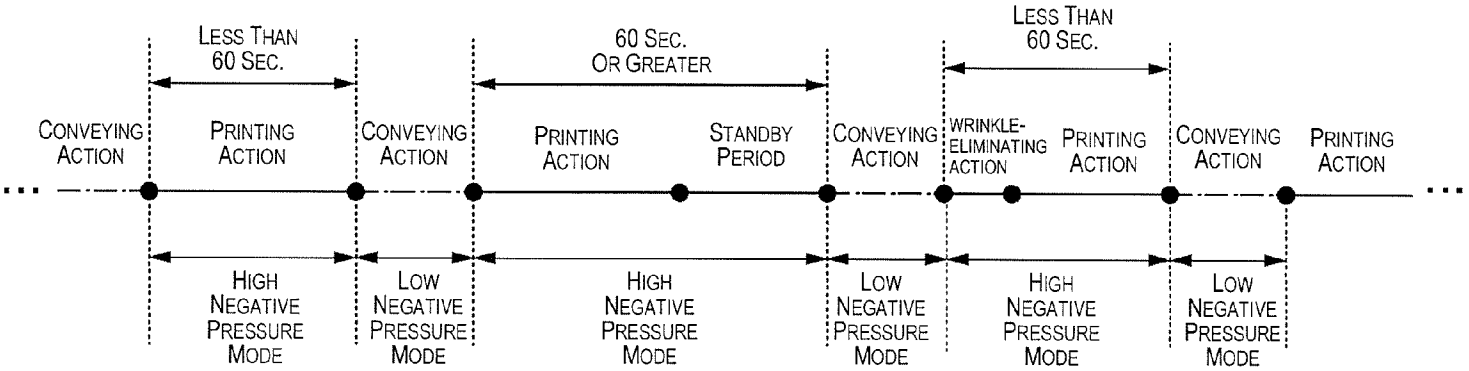
FIGS. 6A and 6B are charts describing other examples of cases in which the period for the conveying action is a predetermined time or greater.
Figure 6B:
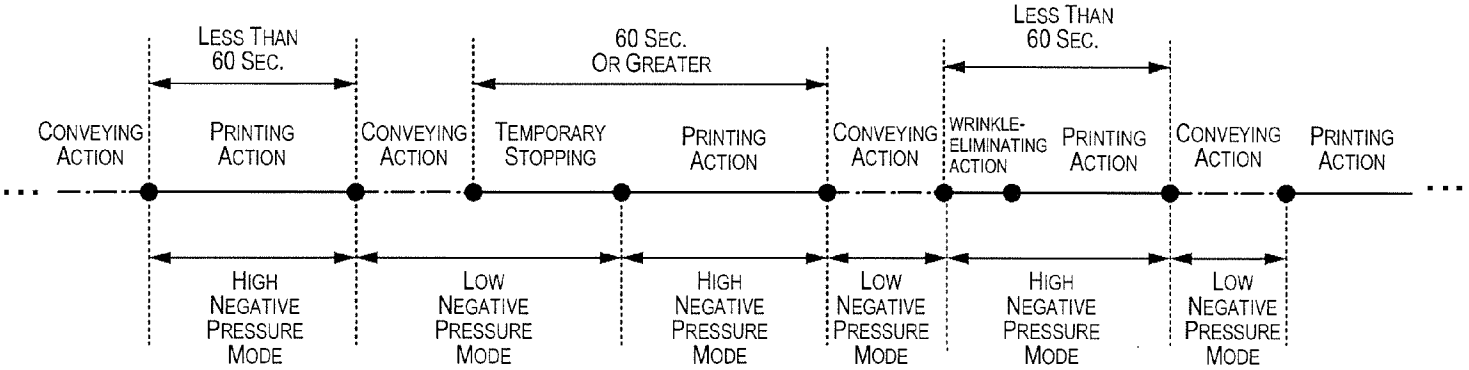

FIGS. 6A and 6B are charts describing other examples of cases in which the period between conveying actions is equal to or greater than the predetermined period. Heretofore has been an example of a printing process in which the period between conveying actions is equal to or greater than the predetermined period (60 seconds) due to the printing action and the maintenance action being performed between conveying actions, but the present invention is not limited to this example.

In another example of the printer 1, a "standby period" can be set, which is a period in which no action is performed following multiple printing actions (or following an overall printing action). With this type of printer, the period between conveying actions will be the total period including the period required by the printing action and the standby period, and will sometimes be equal to or greater than the predetermined period (60 sec). In this case, the same region of the roll paper R is positioned on the heated platen 31 for a long period of time and there is a risk of wrinkles forming in the roll paper R, and the wrinkle-eliminating action is therefore performed after the conveying action following the setting of the standby period. The printing action is thereby performed with wrinkles having been eliminated.

Another example of the printer 1 is one in which the printing action can be temporarily stopped before or after (or during) the printing action. With this type of printer 1, the period between conveying actions will be the total period including the temporarily stopped period and the period required by the printing action, and will sometimes be equal to or greater than the predetermined period (60 sec), as shown in FIG. 6B. In this case, since there is a risk of wrinkles forming in the roll paper R, the wrinkle-eliminating action is performed after the conveying action following the temporary stopping. The printing action is thereby performed with wrinkles having been eliminated.

Actuating the ceiling fans 34 shown in FIG. 2 and blowing air onto the roll paper R has the effect of reducing the temperature difference (the difference in the amount of moisture evaporated) between the region of roll paper R positioned on the heated platen 31 and other regions of the roll paper R. Specifically, actuating the ceiling fans 34 has the effect of impeding wrinkles from forming in the roll paper R. Therefore, it is preferable to actuate the ceiling fans 34 as much as possible. The vibration of the ceiling fans 34 could unfortunately be a cause of noise in the discharge problem inspection and actuating the ceiling fans 34 causes loud sounds, and it is therefore preferable to not actuate the ceiling fans 34 during the maintenance action or during the temporary stopping.

Second Embodiment

FIG. 7 shows a table correlating the period for the wrinkle-eliminating action with types of mediums (roll paper R). According to types, there are mediums susceptible to wrinkles and mediums not susceptible to wrinkles. Therefore, there are instances in which wrinkles form and instances in which wrinkles do not form depending on the type of medium, even if the period for being positioned on the heated platen 31 is the same, and the extent of wrinkles differs depending on the type of medium. The longer the period for the wrinkle-eliminating action, the more wrinkles that can be eliminated and the more severe formed wrinkles that can be eliminated.

In view of this, in the second embodiment, the period for the wrinkle-eliminating action is varied according to the type of medium. For example, film is more resistant to wrinkles than coated paper (e.g. cast paper), and high-quality paper is more susceptible to wrinkles than coated paper. In this case, as shown in FIG. 7, the period for the wrinkle-eliminating action on the high-quality paper which is the most susceptible to wrinkles is set to 15 seconds, the period for the wrinkle-eliminating action on the coated paper which is the next most susceptible to wrinkles is set to the second longest at 10 seconds, and the period for the wrinkle-eliminating action on the film which is most resistant to wrinkles is set to the shortest at 5 seconds.

Thus, by varying the period for the wrinkle-eliminating action in accordance with the type of medium, it is possible to prevent the wrinkle-eliminating action from being performed for longer than is necessary on mediums resistant to wrinkles, and to prevent the overall printing period from being too long. It is also possible to prevent the wrinkle-eliminating action from being performed for too short of a period mediums susceptible to wrinkles, and to prevent the printing action from being performed with wrinkles still remaining. In other words, with the printer 1 of the second embodiment, productivity can be increased while shortening the period required by the wrinkle-eliminating action as much as possible, while reliably eliminating wrinkles that form in the medium.

Therefore, a table (FIG. 7) correlating periods of the wrinkle-eliminating action with types of mediums that can be used by the printer 1 is preferably stored in the memory 13 of the printer 1, for example. The controller 10 then preferably perceives the type of medium being used in the printing on the basis of input results from the user or detection results of a sensor, refers to the table shown in FIG. 7, acquires the wrinkle-eliminating action period corresponding to the medium type, and performs the wrinkle-eliminating action for the acquired period.

Third Embodiment

FIG. 8 shows a table correlating periods of the wrinkle-eliminating action with periods between conveying actions. The longer the period between conveying actions, i.e., the longer the period during which the same region of roll paper R is positioned on the heated platen 31, the more wrinkles that form or the more severe wrinkles that form.

In view of this, in the third embodiment, the period for the wrinkle-eliminating action is varied according to the period between conveying actions (the period from the previous conveying action to the next conveying action). The longer the period between conveying actions, the more wrinkles and the more severe the wrinkles that form; therefore, the period for the wrinkle-eliminating action is increased and wrinkles are reliably eliminated. Conversely, when the period between conveying actions is equal to or greater than the predetermined period yet still comparatively short, the wrinkles formed are fewer and less severe, and wrinkles are therefore eliminated with a short period for the wrinkle-eliminating action. Thus, by varying the period for the wrinkle-eliminating action in accordance with the period between conveying actions, the period required by the wrinkle-eliminating action can be reduced as much as possible while reliably eliminating the wrinkles that form in the medium. As a result, productivity can be increased.

Therefore, as shown in FIG. 8, for example, it is preferable to set multiple ranges for the period between conveying actions (the timer count value), to create a table that correlates wrinkle-eliminating action periods with these ranges, and to store this table in the memory 13 of the printer 1. After acquiring the timer count value, the controller 10 of the printer 1 preferably refers to the table of FIG. 8 and acquires the period for the wrinkle-eliminating action. According to the table of FIG. 8, when the acquired timer count value is 65 seconds, for example, the period for the wrinkle-eliminating action is set to 10 seconds, and when the acquired timer count value is 90 seconds, the period for the wrinkle-eliminating action is set to 20 seconds.

Combining together the second embodiment and the third embodiment, the period for the wrinkle-eliminating action may be varied according to both the type of medium and the period between conveying actions.

Other Embodiments

The present embodiment primarily describes an image recording device, but also includes the disclosure of an image recording method, for example. The present embodiment is intended to make the present invention easier to understand, and should not be interpreted as limiting the present invention. The present invention can of course be modified and improved without deviating from the scope thereof, and such equivalents are also included in the present invention. The embodiments described hereinbelow in particular are also included in the present invention.

Printer

In the embodiment previously described, an example of a printer 1 was given in which an image was printed on roll paper R positioned in a print area while the head 33 was moved in the conveying direction and width direction of the roll paper R, but the present invention is not limited to this example. The printer may also print images when the roll paper R passes underneath a stationary head 33, for example.

The medium on which the image is recorded is not limited to roll paper R and may be single sheets of paper, and the image recording device may record images on the medium by discharging a fluid other than ink from the nozzles.

The image recording device is also not limited to a printer, and the above-described present embodiment and similar technologies may also be applied to various other devices that use the inkjet technology, such as color filter manufacturing devices, dye devices, micromachining devices, semiconductor manufacturing devices, surface machining devices, three-dimensional modeling devices, gasifying and vaporizing devices, organic EL manufacturing devices (particularly macromolecular EL manufacturing devices), display manufacturing devices, film-forming devices, and DNA chip manufacturing devices. These methods and manufacturing methods are also categorized in the applicable range.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image recording device comprising:

a conveying part configured and arranged to convey a portion of a medium to an image recording area;

a recording part configured and arranged to record an image on the medium positioned in the image recording area;

a medium support part configured and arranged to heat the medium positioned in the image recording area and to support the medium on a support surface provided with openings of suction holes;

a suction part configured and arranged to suction the medium supported on the medium support part via the suction holes; and a control part configured to repeatedly perform an action of conveying the medium using the conveying part and a recording action using the recording part, the control part being configured to perform a first conveying action, a first recording action, a second conveying action, and a second recording action in the stated order, and the control part being further configured to perform a suction action after the second conveying action and before the second recording action, wherein the medium supported on the medium support part is suctioned by the suction part, when a period from end of the first conveying action until start of the second conveying action is equal to or greater than a predetermined period that is longer than a period required by the first recording action.

2. The image recording device according to claim 1, wherein the control part is configured to vary a period over which the suction action is performed in accordance with a type of the medium.

3. The image recording device according to claim 1, wherein the control part is configured to vary a period over which the suction action is performed in accordance with a period from a previous conveying action to a next conveying action.

4. The image recording device according to claim 1, wherein the suction part is configured to apply a suction force during the suction action to suction the medium supported on the medium support part, which is greater than a suction force applied during the conveying action to suction the medium supported on the medium support part.

5. An image recording method for recording an image on a medium by an image recording device including:

a conveying part configured and arranged to convey a portion of a medium to an image recording area;

a recording part configured and arranged to record an image on the medium positioned in the image recording area;

a medium support part configured and arranged to heat the medium positioned in the image recording area and to support the medium on a support surface provided with openings of suction holes;

a suction part configured and arranged to suction the medium supported on the medium support part via the suction holes; and a control part configured to repeatedly perform an action of conveying the medium using the conveying part and a recording action using the recording part, the image recording method comprising:

when a period from a previous conveying action until a next conveying action is equal to or greater than a predetermined period that is longer than a period required by the recording action, performing a suction action by using the control part after the next conveying action and before the recording action, wherein the medium supported on the medium support part is suctioned by the suction part.

* * * * *